US008614386B2

(12) United States Patent
Criscuolo

(10) Patent No.: US 8,614,386 B2
(45) Date of Patent: Dec. 24, 2013

(54) PORTABLE MUSICAL RESONATOR

(76) Inventor: Matthew Criscuolo, Wilton, CT (US)

( * ) Notice: Subject to any disclaimer, the term of this patent is extended or adjusted under 35 U.S.C. 154(b) by 0 days.

(21) Appl. No.: 13/270,916

(22) Filed: Oct. 11, 2011

(65) Prior Publication Data

US 2012/0085219 A1 Apr. 12, 2012

Related U.S. Application Data

(60) Provisional application No. 61/391,432, filed on Oct. 8, 2010.

(51) Int. Cl.
*G10D 9/00* (2006.01)

(52) U.S. Cl.
USPC ..... 84/453; 446/416

(58) Field of Classification Search
USPC ..... 84/453; 446/416
See application file for complete search history.

(56) References Cited

U.S. PATENT DOCUMENTS

| | | | | | |
|---|---|---|---|---|---|
| 444,464 | A | * | 1/1891 | Shaver | 181/138 |
| 481,133 | A | * | 8/1892 | Bowen | 181/138 |
| 1,171,163 | A | | 2/1916 | Allen | |
| 1,338,108 | A | | 4/1920 | Sordillo | |
| 1,350,409 | A | | 8/1920 | Humes | |
| 1,539,961 | A | * | 6/1925 | Scott | 181/181 |
| 1,661,525 | A | | 3/1928 | Deerfoot | |
| 1,855,423 | A | * | 4/1932 | Sansone | 84/400 |
| 2,248,352 | A | * | 7/1941 | Humes | 84/400 |
| 2,417,277 | A | * | 3/1947 | Tyson | 84/189 |
| 2,452,809 | A | * | 11/1948 | Tyson | 84/189 |
| 2,470,597 | A | | 5/1949 | Woodward | |
| 3,185,013 | A | * | 5/1965 | Gussak | 84/411 R |
| 3,299,764 | A | * | 1/1967 | Ventura | 84/400 |
| 3,307,055 | A | * | 2/1967 | Schafft | 310/326 |
| 3,347,337 | A | * | 10/1967 | Mochida et al. | 181/157 |
| 3,437,002 | A | * | 4/1969 | Defauw et al. | 84/453 |
| 3,482,026 | A | * | 12/1969 | Babicky | 84/723 |
| 3,593,145 | A | * | 7/1971 | Valley | 455/91 |
| 3,779,125 | A | * | 12/1973 | Quitmeyer | 84/189 |
| 4,012,983 | A | * | 3/1977 | Ploeger | 84/400 |
| 4,187,635 | A | * | 2/1980 | Deissler | 446/416 |
| 4,264,883 | A | * | 4/1981 | Honda | 333/146 |
| 4,998,959 | A | * | 3/1991 | Purdie | 84/400 |
| 5,127,870 | A | * | 7/1992 | Lin | 446/416 |
| 5,179,255 | A | * | 1/1993 | Yeh | 181/182 |
| 5,373,771 | A | * | 12/1994 | Weik et al. | 84/400 |
| 5,567,895 | A | * | 10/1996 | Aspri et al. | 84/294 |
| 5,610,350 | A | * | 3/1997 | Miller | 84/413 |
| 5,780,757 | A | | 7/1998 | Valtchev et al. | |
| 6,040,510 | A | * | 3/2000 | Yaun | 84/294 |
| 6,080,924 | A | * | 6/2000 | Cowen et al. | 84/453 |
| 6,083,075 | A | * | 7/2000 | Meeks | 446/207 |
| 7,259,308 | B2 | * | 8/2007 | Geiger | 84/294 |
| 7,777,109 | B2 | * | 8/2010 | Saragosa | 84/302 |
| 2005/0262987 | A1 | * | 12/2005 | Chen | 84/453 |
| 2012/0085219 | A1 | * | 4/2012 | Criscuolo | 84/410 |

* cited by examiner

*Primary Examiner* — Robert W Horn
(74) *Attorney, Agent, or Firm* — St. Onge Steward Johnston & Reens LLC

(57) ABSTRACT

A portable reverberation device for attaching to a musical instrument with a distal end that can be adjusted to alter a distance between the ends of the portable reverberation device. The device includes a cup attached to a collar to receive incoming sound waves and a spring stretched inside the body. The device further includes an attachment mechanism with a clamp adapted to attach the portable reverberation device to the musical instrument.

15 Claims, 5 Drawing Sheets

PORTABLE MUSICAL RESONATOR

CROSS-REFERENCE TO RELATED APPLICATIONS

The present application claims the benefit under 35 U.S.C. §119(e) of U.S. Provisional Patent Application Ser. No. 61/391,432 filed on Oct. 8, 2010, the content of which is incorporated herein by reference.

FIELD OF THE INVENTION

The present invention relates generally to a device that can reverberate the sound emanating from a musical instrument, and more specifically, relates to a reverberation device that can attach to the the bell of a musical instrument to reverberate the sound produced from the musical instrument.

BACKGROUND OF THE INVENTION

When recording music, an artist or the producer of the music may introduce a reverberation into the recording. A reverberation, or reverb, is created when a sound is produced in an enclosed space causing a large number of echoes to build up and then slowly decay as the sound is absorbed by the walls and air. This is most noticeable when the sound source stops but the reflections continue, until they can no longer be heard. In comparison to a distinct echo that is 50 to 100 ms after the initial sound, reverberation is many thousands of echoes that arrive in very quick succession. As time passes, the volume of the many echoes is reduced until the echoes cannot be heard at all. Adding a slight reverb to a piece of music can make the piece sound more lifelike and more appeasing to the listener.

While it is common practice to add a reverb to a piece of recorded music, reverb is generally not added to live music. A lack of reverberation can make live music seem less lifelike as listeners are more accustomed to hearing a reverb. Musicians do add a reverb to live music to alter the sound and to change the dynamic for the live listener. However, adding a reverb to the live music can be relatively difficult and expensive. To add a reverb to live music, the music is received by a microphone and a reverb is electronically added. This equipment includes microphones, amplifiers, and other equipment that can be particularly expensive, very heavy to carry around, difficult to setup, and difficult to operate. Additionally, the equipment necessary to add an electronic reverb requires a large amount of space, and may not be used in live performances where the stage or performance area is particularly small.

What is desired, therefore, is a portable reverberation device that can add a reverb to live music without the need of expensive and heavy electronic equipment. It is further desired to have a small, portable, and lightweight device that is easily adjustable to the bell of a musical instrument and can be positioned to alter the characteristics of the reverb.

SUMMARY OF THE INVENTION

The invention is a directed to a device that adds a reverberation to live music. The device is lightweight, inexpensive to manufacture, and can be easily added to any musical instrument for use at a live show.

These and other objects of the present invention are achieved by provision of a portable reverberation device for attaching to a musical instrument having a body with a proximal end and a distal end. A receiver is attached to the proximal end of the body. A vibration element is attached to the receiver and the distal end of the body. An attachment mechanism is attached to the proximal end of the body and is adapted to attach the portable reverberation device to a musical instrument.

In some embodiments, the body is shaped as an hourglass. In some embodiments, the attachment mechanism can adjust a distance between the proximal end of the body and a clamp of the attachment along a longitudinal axis of the body. In some embodiments, the attachment mechanism can adjust a lateral distance between the body and a clamp of the attachment mechanism. In some embodiments, the attachment mechanism further comprises a ball joint. In some embodiments, the body has radial slits. In some embodiments, the body has a closeable aperture. In some embodiments, the distal end is adjustable to alter a distance between the proximal end and the distal end. In some embodiments, an aperture in the body is formed as the distal end is extended.

Another embodiment of the present invention is a portable reverberation device for attaching to a musical instrument having an hourglass shaped body with a proximal end and a distal end. A collar is attached to the proximal end of the body. A receiver is attached to the collar and is adapted to receive incoming sound waves. A vibration element is attached to the receiver and the distal end of the body. An attachment mechanism is attached to the proximal end of the body, the attachment mechanism having a clamp adapted to attach the portable reverberation device to a musical instrument. The attachment mechanism is capable of adjusting a distance between the body and the clamp along a longitudinal axis of the body.

In some embodiments, the attachment mechanism can adjust a lateral distance between the body and the clamp. In some embodiments, the attachment mechanism further comprises a ball joint. In some embodiments, radial slits are located along the body. In some embodiments, a closeable aperture is located along the body. In some embodiments, the distal end is adjustable to alter a distance between the proximal end and the distal end. In some embodiments, an aperture in the body is formed as the distal end is extended.

Another embodiment of the present invention is an hourglass shaped portable reverberation device for attaching to a musical instrument having a proximal end and a distal end, the distal end being adjustable to alter a distance between the proximal end and the distal end. A collar is attached to the proximal end of the body. A cup is attached to the collar and is adapted to receive incoming sound waves. A spring is attached to the cup and the distal end of the body. An attachment mechanism, attached to the proximal end of the body, has a clamp adapted to attach the portable reverberation device to a musical instrument, a first extension capable of adjusting a distance between the body and the clamp along a longitudinal axis of the body, a second extension capable of adjusting a lateral distance between the body and the clamp, and a ball joint.

In some embodiments, radial slits are located along the body. In some embodiments, a closeable aperture is located in the body. In some embodiments, an aperture in the body is formed as the distal end is extended.

DETAILED DESCRIPTION OF THE INVENTION

Figure 1:
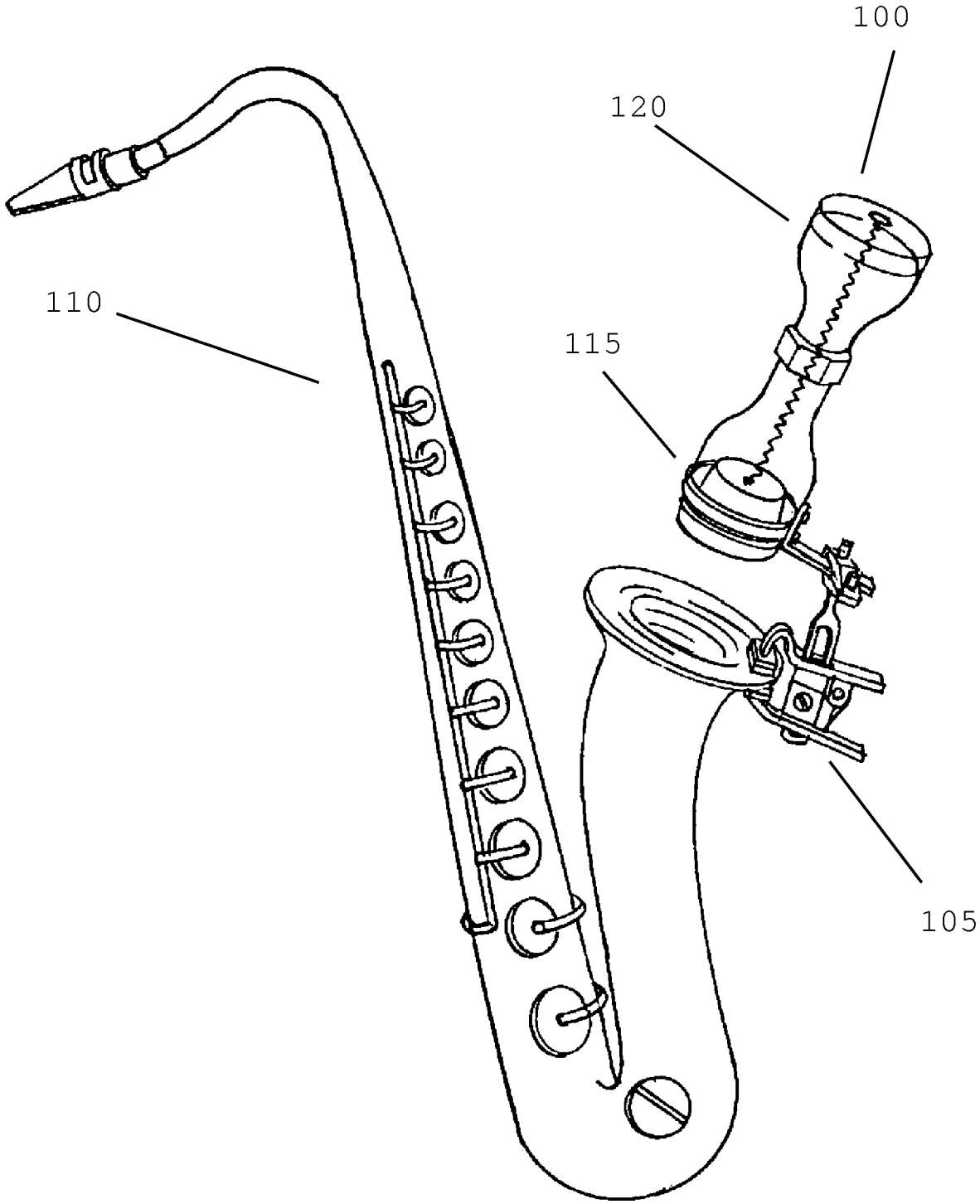
FIG. 1 is a perspective view of a portable reverberation device attached to the bell of a saxophone.

The exemplary embodiments of the present invention may be further understood with reference to the following description and the related appended drawings, wherein like elements are provided with the same reference numerals. The exemplary embodiments of the present invention are related to a device for providing a reverberation of live music. Specifically, the device may be attached to the end of a musical instrument to provide a reverberation of the sound emanating from the instrument. The exemplary embodiments are described with reference to the reverberation device being attached to the bell of a saxophone, but those skilled in the art will understand that the present invention may be used with any musical instrument including musical instruments without a bell.

As best seen in FIG. 1, a perspective view of a portable reverberation device 100 attached to the bell of a saxophone 110 is shown. Portable reverberation device 100 is lightweight, preferably made from plastic or any other lightweight material. It is important to keep the weight of portable reverberation device 100 low so as to make the portable reverberation device 100 not only easy to transport, but to prevent a significant amount of weight from being added to the end of saxophone 110, making saxophone 110 more difficult to play.

Portable reverberation device 100 has an attachment mechanism 105 that is used to attach portable reverberation device 100 to the bell of saxophone 110. When portable reverberation device 100 is attached to the bell of saxophone 110, sound emanating from the bell is received into portable reverberation device 100, which then produces a reverberation in the received sound. The reverberated sound exits the portable reverberation device 100 and can either be received by a microphone for amplification, or received directly by the listener. The use of portable reverberation device 100 eliminates the need to digitally add a reverberation which can require expensive and heavy digital equipment, and can also require additional training to add the most pleasing reverberation.

Attachment mechanism 105 is used to attach portable reverberation device 100 to the bell of saxophone 110 at a proximal end 115. Attachment mechanism 105 can adjust a distance between the bell of saxophone 110 and the receiver of portable reverberation device 100. Attachment mechanism 105 also allows for the adjustment of the lateral distance between the body of portable reverberation device 100 and attachment mechanism 105. The adjustment of the above distances, and the angle as described below, allows the musician to change the reverberation characteristics and sound generated by portable reverberation device 100. Additionally, attachment mechanism 105 can rotate in at least 3 degrees of freedom about the bell of saxophone 110 changing the angle of entry of the sound waves of portable reverberation device 100 to the body and change the angle of transmission of the sound emanating from portable reverberation device 100, which will alter the sound heard by the listener and the musician.

When playing live music, it can be difficult for the musician to hear the music they are playing. Portable reverberation device 100 also provides an echo to the musician in addition to a reverberation. Sound emanating from the bell of saxophone 110 can be reflected off of portable reverberation device 100, and the reverberation from portable device 100, is transmitted back to the musician, allowing the musician to hear the music they are playing. This makes it easier for the musician to play live music in cases where the musician is not able to wear headphones that receive the music played by the musician.

Figure 2:
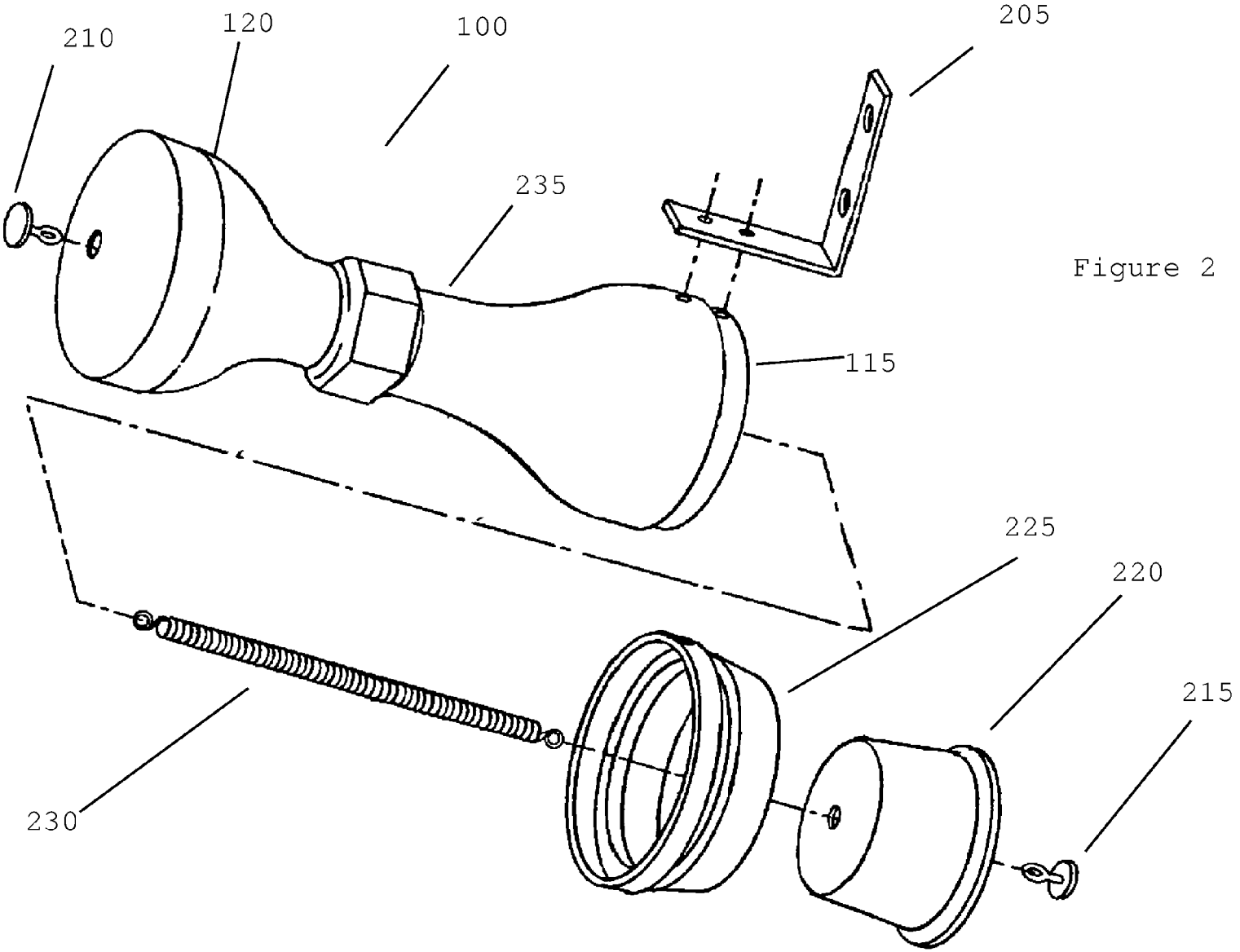
FIG. 2 is an exploded view of a portion of the portable reverberation device according to FIG. 1.

As best seen in FIG. 2, an exploded view of the portable reverberation device 100 according to FIG. 1 is shown. Portable reverberation device 100 has a body 235, which is preferably hourglass shaped, although body 235 can be any shape. The hourglass shape directs the sound waves inside of body 235 towards the ends of body 235. As sound waves emanate from the vibration element described below, the hourglass shape, having an indent, reflects the sound waves to the proximal end 115 and the distal end 120. As body 235 may have apertures and windows (as described in detail below), sound emanates from each end of portable reverberation device 100 as directed by the hourglass shape.

Body 235 has a proximal end 115 which is positioned closer to saxophone 110 than distal end 120. Proximal end 115 is attached to attachment mechanism 105 through an L-shaped bracket 205. L-shaped bracket 205 can be secured to body 235 through one or more screws, tape, adhesive, or any other known method of attaching two items together.

Portable reverberation device 100 includes a receiver 220. In the exemplary embodiment, the receiver 220 is cup-shaped and is made from a thin, flexible material that vibrates in response to the sound waves emanating from saxophone 110. The cup shape, and the thin, flexible, material allows receiver 220 to receive the incoming sound waves from saxophone 110 causing the receiver to vibrate. The receiver then transfers the vibration to vibration element 230. Receiver 220 is attached to body 235 through a collar or cap 225. Collar 225 holds receiver 220 in place, and keeps receiver 220 secured to body 235. It should be noted, however, that collar 225 need not be present, and receiver 220 can be attached directly to body 235 or formed as a single piece with body 235.

Receiver 220 is attached to a vibration element 230 through securing mechanism 215. In the exemplary embodiment, vibration element 230 is a spring, preferably a metal spring, with a hook/loop at either end. Vibration element 230 is attached to securing mechanism 215 through a corresponding loop. The loop on securing mechanism 215 fits through a hole in receiver 220 and is attached to vibration element 230. Vibration element 230 is attached to a distal end 120 of body 235, through a securing mechanism 210, which is similar to securing mechanism 215. Securing mechanism 210 has a loop which fits through a hole in the distal end 120 of body 235 and attaches to vibration element 230.

When sound enters receiver 220 a vibration is caused in receiver 220, which is transferred to vibration element 230. Vibration element 230 causes a reverberation in the received sound, and sends the reverberated sound to the interior of body 235 and then out of body 235. The reverberation emanating from vibration element 230 may be adjusted to vibrate more or less using differing securing mechanisms 210 and 215. Additionally, different spring thicknesses, different spring tensions, and different types of springs may alter the characteristics of the generated reverberation.

Figure 3:
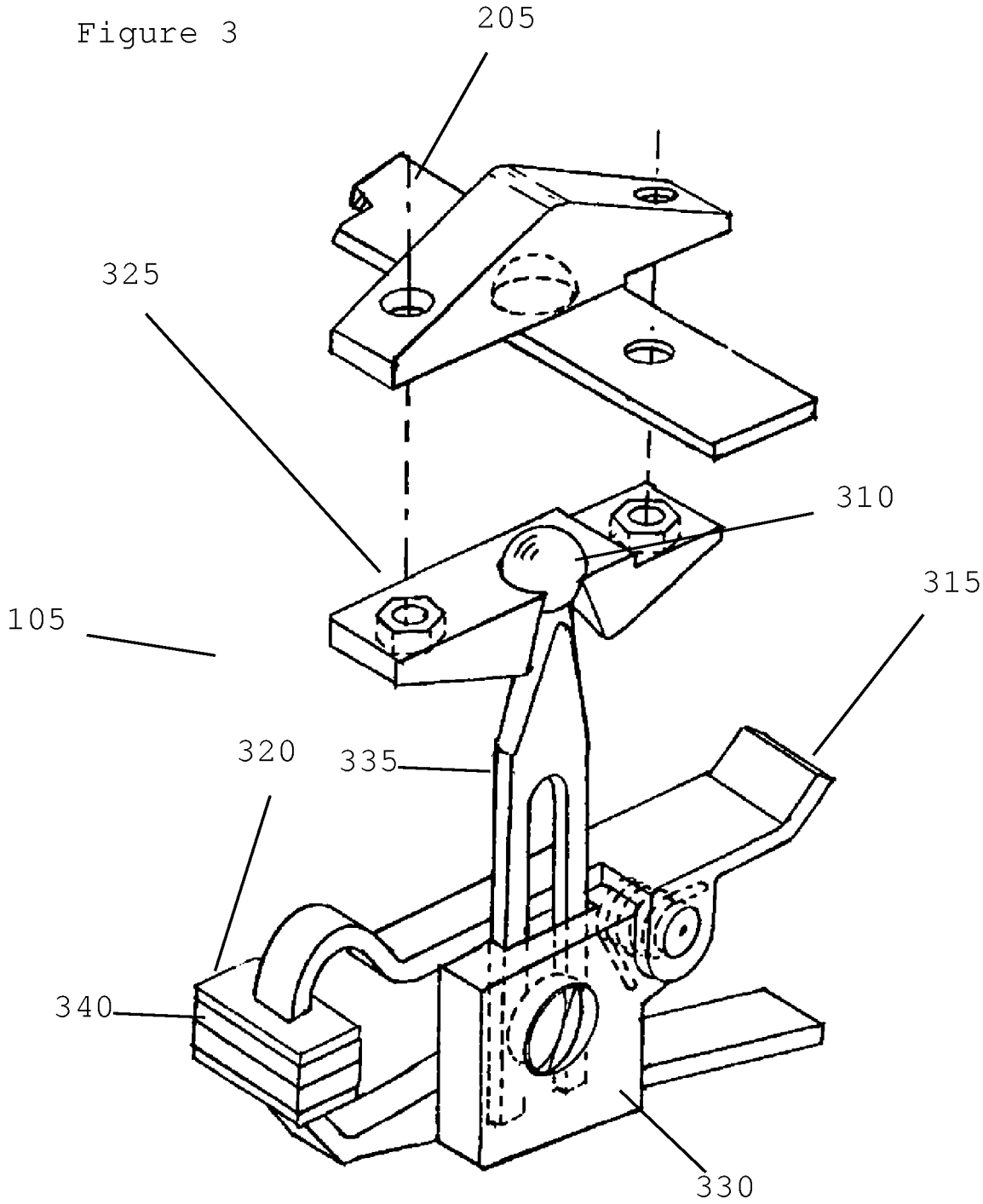
FIG. 3 is an exploded view of the attachment mechanism of the portable reverberation device according to FIG. 1.

As best seen in FIG. 3, an exploded view of the attachment mechanism 105 of portable reverberation device 100 is shown. Attachment mechanism 105 includes an upper portion 325 that attaches to a lower portion 330 by encapsulating ball joint 310 of lower portion 335. L-shaped bracket 205 is attached directly to upper portion 325 using a plurality of screws or similar securing mechanism. L-shaped bracket 205 can be adjusted to alter the distance between body 235 and upper portion 325.

Attachment mechanism 105 includes a ball joint 310 which allows for 3 degrees of freedom about the bell of saxophone 110. Ball joint 310 is attached to an extension 335 which adjusts a distance between upper portion 325 and lower portion 330. Attachment mechanism 105 further includes a clamp 315 having pads 340 to allow for easy attachment and removal of portable reverberation device 100 to saxophone 110. When a musician presses down on clamp 315, jaws 320, which are padded to prevent damage to saxophone 110, are opened for the bell of saxophone 110 to be inserted. To remove portable reverberation device 100, clamp 315 is actuated, opening jaws 320, and portable reverberation device 100 is removed from the bell of saxophone 110.

Figure 4:
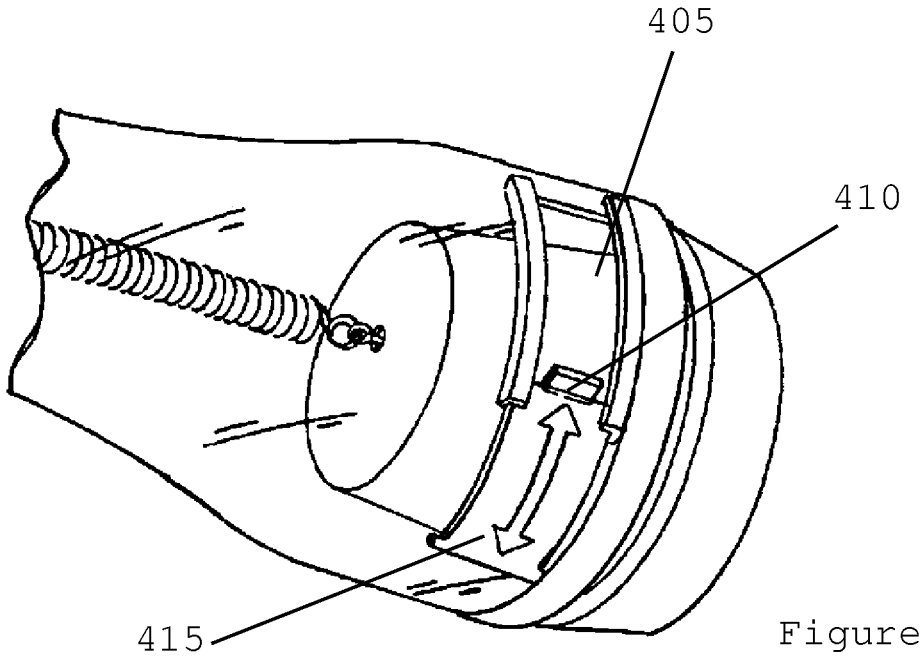
FIG. 4 is a close-up view of one end of an embodiment of the portable reverberation device.

As best seen in FIG. 4, a close-up view of the first end of portable reverberation device 100 is shown. The first end may include an aperture 405. A closeable window 415, actuated by handle 410, can cover all or a portion of aperture 405. The change in the size of the opening created by aperture 405 and the amount covered by window 415, can adjust the amount of reverberation that exits portable reverberation device 100. This allows the musician to modify the volume, sound, and tone of the reverberation emanating from portable reverberation device 100. It should be noted that while aperture 405 and window 415 are shown on the end of body 235 closest to receiver 220, aperture 405 and window 415 can be at any location along body 235 not limited to the proximal end. Additionally, while aperture 405 and window 415 are shown to be rectangular, aperture 405 and window 415 can be of any shape and of any size.

Figure 5:
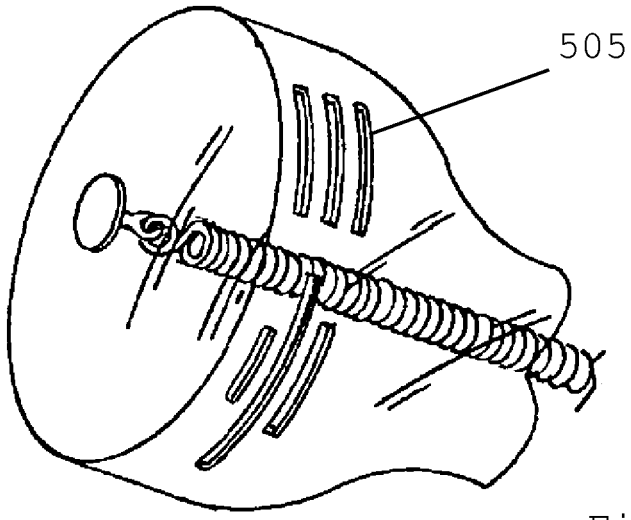
FIG. 5 is a close-up view of one end of an embodiment of the portable reverberation.

As best seen in FIG. 5, a close-up view of one end of portable reverberation device 100 is shown. Portable reverberation device 100 may include one or more radial slits 505 in body 235. Radial slits 505 allow for the sounds waves emanating from vibration element 230 to exit body 235. The more radial slits 505 present in body 235, the more sound waves and reverberation that can exit body 235, modifying the volume, tone, and overall effect of the reverberation. It should be noted that while radial slits 505 are shown at the distal end 120 of body 235, radial slits 505 can be located at any location along body 235, and can further be in the longitudinal direction to that of body 235 instead of a radial direction. Additionally, it should be noted that while radial slits 505 are shown to be rectangular and narrow, radial slits 505 can be of any shape and size.

Figure 6:
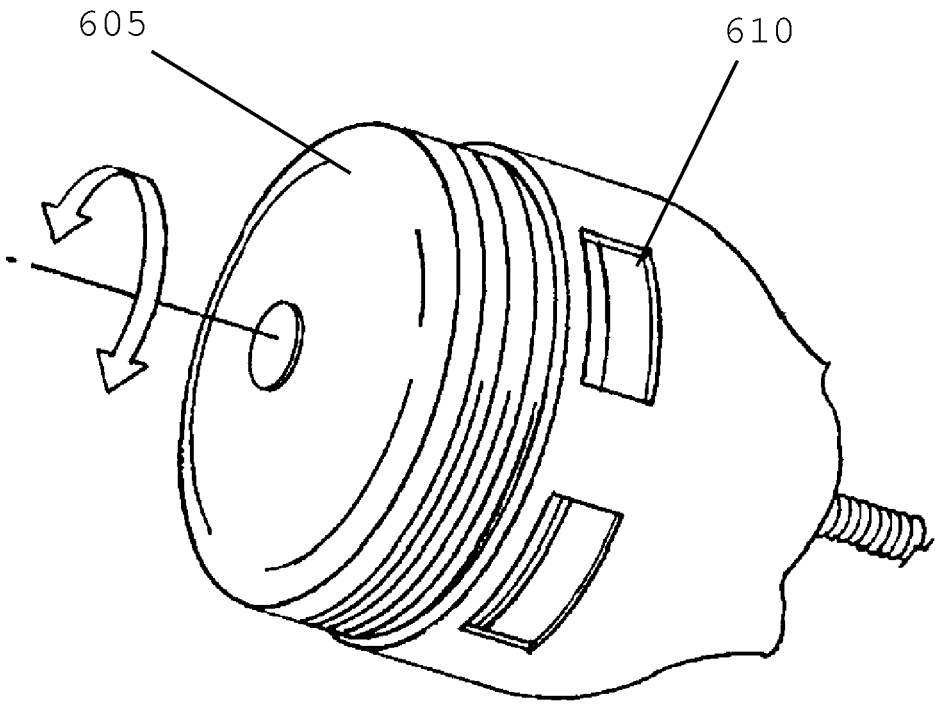
FIG. 6 is a close-up view of one end of an embodiment of the portable reverberation device with an adjustable end.

As best seen in FIG. 6, a close-up view of one end of portable reverberation device 100 is shown. The end of portable reverberation device 100 that is opposite to that of receiver 220 may include an extendable or removable portion 605. Extendable portion 605 may be rotated to increase or decrease the distance between either end of body 235, which may increase or decrease the length and tension in the spring to alter vibration, thus altering the quality of the reverberation emanating from vibration element 230. Extendable portion 605 may be threaded with body 235, either internally or externally, to attach extendable portion 605 to body 235. The increase and decrease in the length of vibration element 230 can adjust the reverberating sound emanating from portable reverberation device 100. Additionally, there may be one or more apertures 610 present whose size increases or decreases depending on whether extendable portion 605 is extended from or retracted into body 235. It should be noted that while aperture 610 is shown to be rectangular, aperture 610 can be of any shape and of any size.

Figure 7:
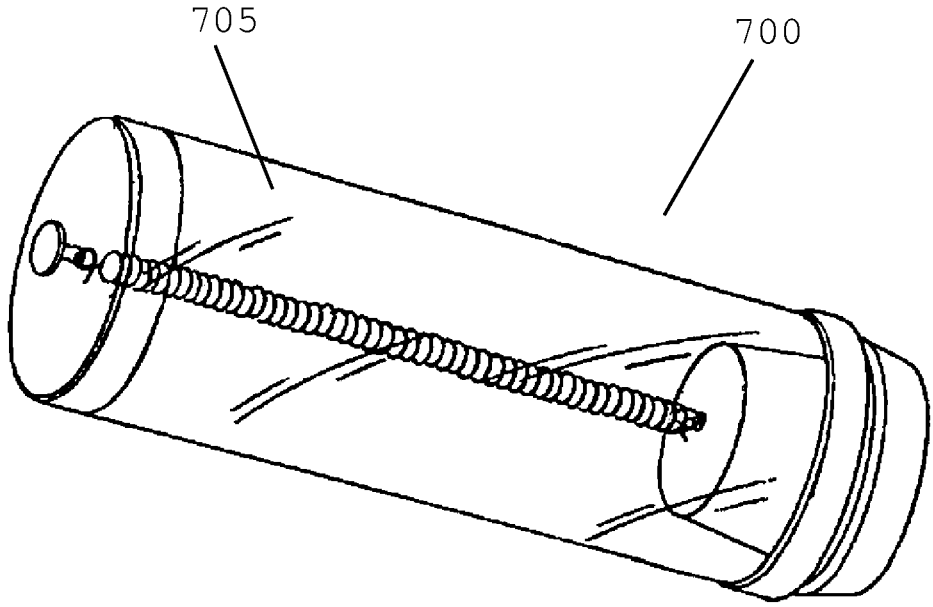
FIG. 7 is a perspective view of another embodiment of the portable reverberation device.

As best seen in FIG. 7, a perspective view of another embodiment of the portable reverberation device 700. Portable reverberation device 700 includes a cylindrically shaped body 705. As there is no indent in body 705 to direct the sound waves to the ends of body 705, sound may emanate from the entire body 705. Additionally, the reverberated sound waves may remain within body 705 for a longer period of time, increasing the duration of the reverberation.

This device has the advantage in that it is inexpensive to manufacture, light weight, easily portable and attachable to a musical instrument, and eliminates the need for expensive digital equipment. The device provides a better listening experience to the listener, as well as allowing the musician to hear what they are playing. It allows for a reverberation to be added in almost any situation and almost any live musical setting.

It would be appreciated by those skilled in the art that various changes and modification can be made to the illustrated embodiment without departing from the spirit of the invention. All such modification and changes are intended to be covered hereby.

What is claimed is:

1. A portable reverberation device for attaching to a musical instrument, comprising:
   - a body having a proximal end and a distal end;
   - a receiver attached to said proximal end of said body that is adapted to receive sound waves from said musical instrument;
   - a vibration element attached to said receiver and said distal end of said body; and
   - an adjustable attachment mechanism comprising a clamp, said attachment mechanism attached to said body and to said musical instrument;
   - wherein said attachment mechanism can adjust a distance between said proximal end of said body and said clamp of said attachment mechanism.

2. The portable reverberation device of claim 1, further comprising:
   - a closeable aperture in said body.

3. The portable reverberation device of claim 1, wherein said attachment mechanism can adjust a distance between said proximal end of said body and said clamp of said attachment mechanism along a longitudinal axis of said body.

4. The portable reverberation device of claim 1, wherein said attachment mechanism can adjust a lateral distance between said body and said clamp of said attachment mechanism.

5. The portable reverberation device of claim 1, wherein said attachment mechanism comprises a ball joint.

6. The portable reverberation device of claim 1, wherein said attachment mechanism can adjust the angle of said body relative to the musical instrument along at least three degrees of freedom.

7. A portable reverberation device for attaching to a musical instrument, comprising:
   - a body having a proximal end and a distal end;
   - a receiver attached to said proximal end of said body;
   - a vibration element attached to said receiver and said distal end of said body;
   - an attachment mechanism attached to said proximal end of said body, said attachment mechanism adapted to attach said portable reverberation device to a musical instrument; and
   - a closeable aperture in said body.

8. The portable reverberation device of claim 7, wherein said attachment mechanism can adjust a distance between said proximal end of said body and a clamp of said attachment along a longitudinal axis of said body.

9. The portable reverberation device of claim 7, wherein said attachment mechanism can adjust a lateral distance between said body and a clamp of said attachment mechanism.

10. The portable reverberation device of claim 7, wherein said attachment mechanism can adjust the angle of said body relative to the musical instrument along at least three degrees of freedom.

11. A portable reverberation device for attaching to a musical instrument, comprising:

a body having a proximal end and a distal end;

a receiver attached to said proximal end of said body;

a vibration element attached to said receiver and said distal end of said body; and an attachment mechanism attached to said proximal end of said body, said attachment mechanism adapted to attach said portable reverberation device to a musical instrument;

wherein said distal end is adjustable to alter a distance between said proximal end and said distal end.

12. The portable reverberation device of claim 11, wherein an aperture in said body is formed as said distal end is extended.

13. The portable reverberation device of claim 11, wherein said attachment mechanism can adjust a distance between said proximal end of said body and a clamp of said attachment along a longitudinal axis of said body.

14. The portable reverberation device of claim 11, wherein said attachment mechanism can adjust a lateral distance between said body and a clamp of said attachment mechanism.

15. The portable reverberation device of claim 11, wherein said attachment mechanism can adjust the angle of said body relative to the musical instrument along at least three degrees of freedom.

* * * * *